US010480391B2

(12) United States Patent
Gonze et al.

(10) Patent No.: US 10,480,391 B2
(45) Date of Patent: Nov. 19, 2019

(54) COOLANT CONTROL SYSTEMS AND METHODS TO PREVENT COOLANT BOILING

(71) Applicant: GM Global Technology Operations LLC, Detroit, MI (US)

(72) Inventors: Eugene V. Gonze, Pinckney, MI (US); Yue-Ming Chen, Canton, MI (US); Vijay Ramappan, Novi, MI (US); Ben W. Moscherosch, Waterford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1050 days.

(21) Appl. No.: 14/495,141

(22) Filed: Sep. 24, 2014

(65) Prior Publication Data

US 2016/0047293 A1 Feb. 18, 2016

Related U.S. Application Data

(60) Provisional application No. 62/036,833, filed on Aug. 13, 2014.

(51) Int. Cl.

| | |
|---|---|
| ***F01P 7/14*** | (2006.01) |
| ***F01P 5/10*** | (2006.01) |
| ***F01P 7/16*** | (2006.01) |

(52) U.S. Cl.

CPC *F01P 7/14* (2013.01); *F01P 5/10* (2013.01); *F01P 7/164* (2013.01); *F01P 7/167* (2013.01)

(58) Field of Classification Search

CPC .... F01P 7/164; F01P 7/167; F01P 5/10; F01P 7/16; F01P 2037/00; F01P 7/00

USPC ..... 123/41.01, 41.02, 478, 41.08

See application file for complete search history.

(56) References Cited

U.S. PATENT DOCUMENTS

| | | | | |
|---|---|---|---|---|
| 4,197,712 | A | 4/1980 | Zwick et al. | |
| 4,367,699 | A | 1/1983 | Evans | |
| 5,724,924 | A * | 3/1998 | Michels | F01P 7/044 123/41.12 |
| 6,033,187 | A | 3/2000 | Addie | |
| 6,568,428 | B2 | 5/2003 | Pecci et al. | |

(Continued)

FOREIGN PATENT DOCUMENTS

| | | | |
|---|---|---|---|
| CN | 101067395 | A | 11/2007 |
| CN | 101109310 | A | 1/2008 |

(Continued)

OTHER PUBLICATIONS

U.S. Appl. No. 14/494,904, filed Sep. 24, 2014, Gonze et al.

(Continued)

*Primary Examiner* — Long T Tran
*Assistant Examiner* — James J Kim

(57) ABSTRACT

A coolant control system of a vehicle includes first and second target flowrate modules, a target speed module, and a speed control module. The first target flowrate module determines a first target flowrate of coolant through an engine. The second target flowrate module, when a change in heat input to the engine is greater than a predetermined value, sets a second target flowrate to greater than the first target flowrate. The target speed module determines a target speed of an engine coolant pump based on the second target flowrate. The speed control module controls a speed of the engine coolant pump based on the target speed.

13 Claims, 5 Drawing Sheets

(56) References Cited

U.S. PATENT DOCUMENTS

| | | | | |
|---|---|---|---|---|
| 6,994,316 | B2 | 2/2006 | Pervaiz | |
| 7,296,543 | B2 | 11/2007 | Namuduri et al. | |
| 7,509,999 | B2 * | 3/2009 | Angelis | F04D 13/024 165/104.33 |
| 8,869,757 | B2 | 10/2014 | Kim et al. | |
| 9,080,573 | B2 | 7/2015 | Welte et al. | |
| 9,188,053 | B2 * | 11/2015 | Abihana | F01P 7/164 |
| 9,239,306 | B2 | 1/2016 | Okamoto | |
| 9,683,561 | B2 | 6/2017 | Ruhle et al. | |
| 9,719,407 | B2 | 8/2017 | Schwartz et al. | |
| 2003/0019442 | A1 | 1/2003 | Yoshikawa et al. | |
| 2004/0035194 | A1 | 2/2004 | Wakahara | |
| 2007/0272173 | A1 | 11/2007 | Reckels et al. | |
| 2009/0205588 | A1 * | 8/2009 | Bilezikjian | F01P 7/164 123/41.02 |
| 2009/0277601 | A1 * | 11/2009 | Al-Shawaf | F28D 1/0435 165/44 |
| 2009/0301409 | A1 | 12/2009 | Dahl et al. | |
| 2010/0154730 | A1 * | 6/2010 | Scolton | F01P 7/167 123/41.09 |
| 2012/0137991 | A1 | 6/2012 | Pae et al. | |
| 2012/0204818 | A1 | 8/2012 | Welte et al. | |
| 2012/0296547 | A1 | 11/2012 | Bialas et al. | |
| 2015/0027572 | A1 | 1/2015 | Morein et al. | |
| 2015/0027575 | A1 * | 1/2015 | Morein | F16K 11/165 137/865 |
| 2015/0051768 | A1 * | 2/2015 | Miyamoto | B60W 20/00 701/22 |
| 2015/0053777 | A1 | 2/2015 | Iwasaki | |
| 2015/0275713 | A1 * | 10/2015 | Bidner | F01M 1/02 123/41.42 |

FOREIGN PATENT DOCUMENTS

| | | | |
|---|---|---|---|
| CN | 101788801 | A | 7/2010 |
| CN | 102027239 | A | 4/2011 |
| CN | 102086803 | A | 6/2011 |
| CN | 102635556 | A | 8/2012 |
| CN | 102705056 | A | 10/2012 |
| CN | 103311890 | A | 9/2013 |
| CN | 103334820 | A | 10/2013 |
| CN | 103573378 | A | 2/2014 |
| CN | 103975180 | A | 8/2014 |
| DE | 3810174 | A1 | 10/1989 |
| DE | 102013109365 | A1 | 3/2015 |
| JP | 2007023989 | A | 2/2007 |
| JP | 2011089480 | A | 5/2011 |
| JP | 2013194716 | A | 9/2013 |
| KR | 20140079569 | A | 6/2014 |

OTHER PUBLICATIONS

U.S. Appl. No. 14/495,037, filed Sep. 24, 2014, Gonze et al.
U.S. Appl. No. 14/495,265, filed Sep. 24, 2014, Gonze et al.
First Office Action for Chinese Application 201510495079.4 dated Jun. 28, 2017 with English translation; 12 pages.
First Office Action for Chinese Application No. 201510495052.5 dated Aug. 3, 2017 with English translation; 19 pages.
First Office Action for Chinese Application No. 201510495298.2 dated May 10, 2017; 5 pages.
First Office Action for Chinese Application No. 201510495332.6 dated Mar. 30, 2018; 10 pages.
First Office Action for German Application No. 10 2015 113 200.1 dated Oct. 1, 2018; 6 pages.

* cited by examiner

COOLANT CONTROL SYSTEMS AND METHODS TO PREVENT COOLANT BOILING

CROSS-REFERENCE TO RELATED APPLICATIONS

This application claims the benefit of U.S. Provisional Application No. 62/036,833, filed on Aug. 13, 2014. The disclosure of the above application is incorporated herein by reference in its entirety.

This application is related to U.S. patent application Ser. No. 14/494,904, which is filed on the same day as this application and claims the benefit of U.S. Provisional Application No. 62/036,766 filed on Aug. 13, 2014; Ser. No. 14/495,037 filed on on the same day as this application and claims the benefit of U.S. Provisional Application No. 62/036,814 filed on Aug. 13, 2014; and Ser. No. 14/495,265 filed on on the same day as this application and claims the benefit of U.S. Provisional Application No. 62/036,862 filed on Aug. 13, 2014. The entire disclosures of the above applications are incorporated herein by reference.

FIELD

The present disclosure relates to vehicles with internal combustion engines and more particularly to systems and methods for controlling engine coolant flow.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine combusts air and fuel within cylinders to generate drive torque. Combustion of air and fuel also generates heat and exhaust. Exhaust produced by an engine flows through an exhaust system before being expelled to atmosphere.

Excessive heating may shorten the lifetime of the engine, engine components, and/or other components of a vehicle. As such, vehicles that include an internal combustion engine typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

In a feature, a coolant control system for a vehicle is disclosed. A first target flowrate module determines a first target flowrate of coolant through an engine. A second target flowrate module, when a change in heat input to the engine is greater than a predetermined value, sets a second target flowrate to greater than the first target flowrate. A target speed module determines a target speed of an engine coolant pump based on the second target flowrate. A speed control module controls a speed of the engine coolant pump based on the target speed.

In further features, a flowrate adjustment module, when the change in heat input to the engine is greater than the predetermined value, determines a flowrate adjustment based on the change in heat input to the engine. The second target flowrate module sets the second target flowrate to greater than the first target flowrate based on the flowrate adjustment.

In further features, the flowrate adjustment module increases the flowrate adjustment as the change in heat input to the engine increases.

In further features, the flowrate adjustment module decreases the flowrate adjustment as the change in heat input to the engine decreases.

In further features: when the change in heat input to the engine is greater than the predetermined value, the flowrate adjustment module further determines a period for increasing coolant flow through the engine; and the second target flowrate module sets the second target flowrate to greater than the first target flowrate for the period.

In further features, the flowrate adjustment module determines the period for increasing coolant flow through the engine based on the change in heat input to the engine.

In further features, the second target flowrate module sets the second target flowrate equal to the first target flowrate plus the flowrate adjustment.

In further features, the second target flowrate module selectively sets the second target flowrate equal to the first target flowrate when the change in heat input to the engine is less than the predetermined value.

In further features, the first target flowrate module determines the first target flowrate based on an engine torque and an engine speed.

In further features, a heat input module that determines the heat input to the engine based on the engine torque and the engine speed.

In a feature, a coolant control method for a vehicle is disclosed. The coolant control method includes: determining a first target flowrate of coolant through an engine; when a change in heat input to the engine is greater than a predetermined value, setting a second target flowrate to greater than the first target flowrate; determining a target speed of an engine coolant pump based on the second target flowrate; and controlling a speed of the engine coolant pump based on the target speed.

In further features, the coolant control method further includes: when the change in heat input to the engine is greater than the predetermined value, determining a flowrate adjustment based on the change in heat input to the engine; and setting the second target flowrate to greater than the first target flowrate based on the flowrate adjustment.

In further features, the coolant control method further includes: increasing the flowrate adjustment as the change in heat input to the engine increases.

In further features, the coolant control method further includes: decreasing the flowrate adjustment as the change in heat input to the engine decreases.

In further features, the coolant control method further includes: when the change in heat input to the engine is greater than the predetermined value, determining a period for increasing coolant flow through the engine; and setting the second target flowrate to greater than the first target flowrate for the period.

In further features, the coolant control method further includes: determining the period for increasing coolant flow through the engine based on the change in heat input to the engine.

In further features, the coolant control method further includes: setting the second target flowrate equal to the first target flowrate plus the flowrate adjustment.

In further features, the coolant control method further includes: selectively setting the second target flowrate equal to the first target flowrate when the change in heat input to the engine is less than the predetermined value.

In further features, the coolant control method further includes: determining the first target flowrate based on an engine torque and an engine speed.

In further features, the coolant control method further includes: determining the heat input to the engine based on the engine torque and the engine speed.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts air and fuel to generate drive torque. A coolant system includes a coolant pump that circulates coolant through various portions of the engine, such as a cylinder head, an engine block, and an integrated exhaust manifold (IEM). Traditionally, the engine coolant is used to absorb heat from the engine, engine oil, transmission fluid, and other components and to transfer heat to air via one or more heat exchangers.

A pump control module controls the coolant pump based on a target flowrate of coolant through the engine. The pump control module may determine the target flowrate based on a torque output of the engine and an engine speed. Determining the target flowrate based on the engine torque output and the engine speed may enable coolant flow to be controlled to provide sufficient cooling for the operating conditions and to also avoid overcooling to maximize fuel efficiency.

When coolant flow is controlled in this way, however, the target flowrate may provide insufficient cooling when heat input to the engine increases quickly, such as during vehicle acceleration. The pump control module of the present disclosure therefore selectively increases the target flowrate of coolant through the engine when a change in heat input to the engine is greater than a predetermined value. Increasing the target flowrate of coolant through the engine provides sufficient cooling and prevents boiling of the engine coolant.

Figure 1:
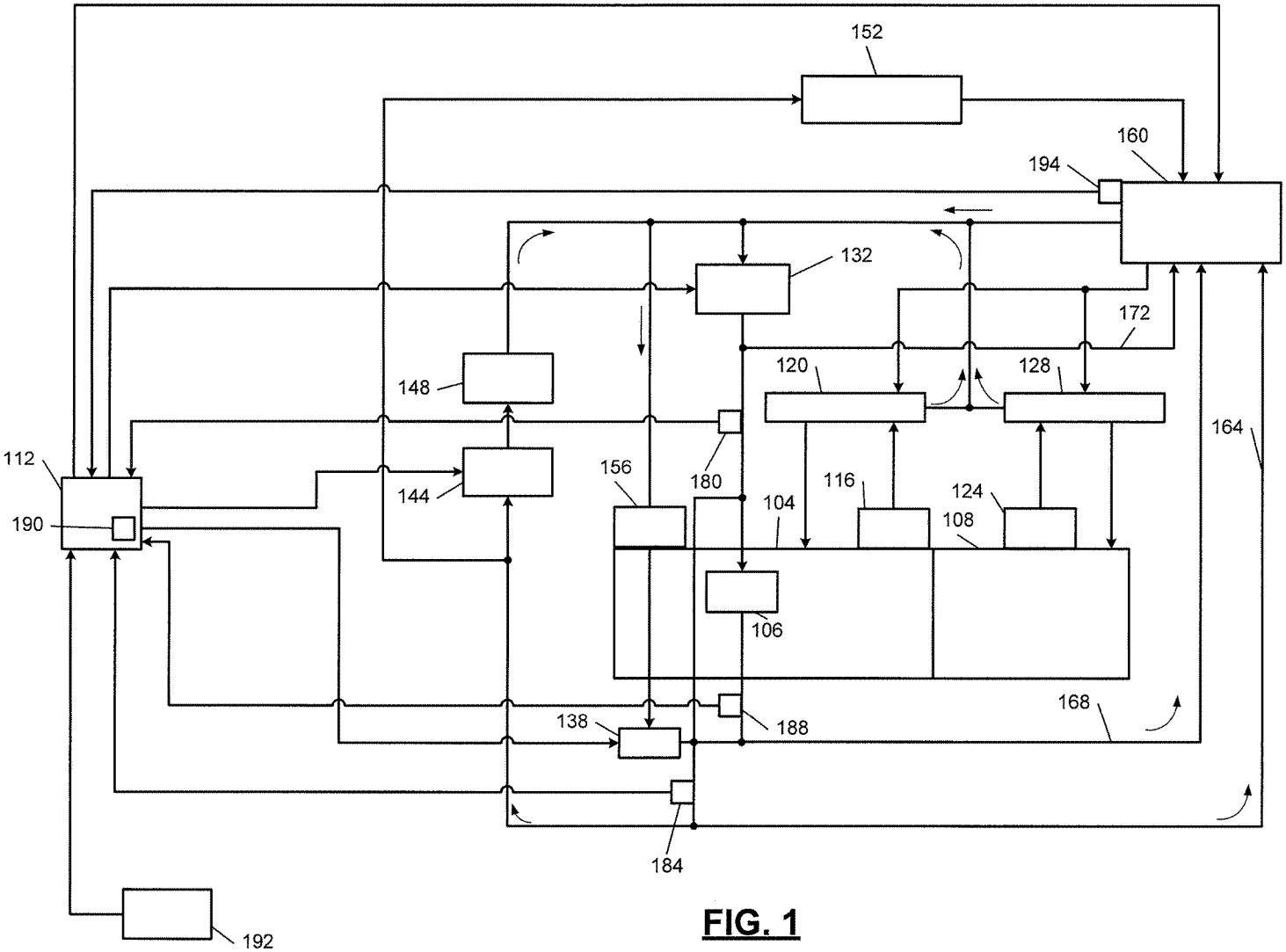
FIG. 1 is a functional block diagram of an example vehicle system.

Referring now to FIG. 1, a functional block diagram of an example vehicle system is presented. An engine 104 combusts a mixture of air and fuel within cylinders to generate drive torque. An integrated exhaust manifold (IEM) 106 receives exhaust output from the cylinders and is integrated with a portion of the engine 104, such as a head portion of the engine 104.

The engine 104 outputs torque to a transmission 108. The transmission 108 transfers torque to one or more wheels of a vehicle via a driveline (not shown). An engine control module (ECM) 112 may control one or more engine actuators to regulate the torque output of the engine 104.

An engine oil pump 116 circulates engine oil through the engine 104 and a first heat exchanger 120. The first heat exchanger 120 may be referred to as an (engine) oil cooler or an oil heat exchanger (HEX). When the engine oil is cold, the first heat exchanger 120 may transfer heat to engine oil within the first heat exchanger 120 from coolant flowing through the first heat exchanger 120. The first heat exchanger 120 may transfer heat from the engine oil to coolant flowing through the first heat exchanger 120 and/or to air passing the first heat exchanger 120 when the engine oil is warm.

A transmission fluid pump 124 circulates transmission fluid through the transmission 108 and a second heat exchanger 128. The second heat exchanger 128 may be referred to as a transmission cooler or as a transmission heat exchanger. When the transmission fluid is cold, the second heat exchanger 128 may transfer heat to transmission fluid within the second heat exchanger 128 from coolant flowing through the second heat exchanger 128. The second heat exchanger 128 may transfer heat from the transmission fluid to coolant flowing through the second heat exchanger 128 and/or to air passing the second heat exchanger 128 when the transmission fluid is warm.

The engine 104 includes a plurality of channels through which engine coolant ("coolant") can flow. For example, the engine 104 may include one or more channels through the head portion of the engine 104, one or more channels through a block portion of the engine 104, and/or one or more channels through the IEM 106. The engine 104 may also include one or more other suitable coolant channels.

When a coolant pump 132 is on, the coolant pump 132 pumps coolant to various channels. While the coolant pump 132 is shown and will be discussed as an electric coolant pump, the coolant pump 132 may alternatively be mechanically driven (e.g., by the engine 104) or another suitable type of variable output coolant pump.

A block valve (BV) 138 may regulate coolant flow out of (and therefore through) the block portion of the engine 104. A heater valve 144 may regulate coolant flow to (and therefore through) a third heat exchanger 148. The third heat exchanger 148 may also be referred to as a heater core. Air may be circulated past the third heat exchanger 148, for example, to warm a passenger cabin of the vehicle.

Coolant output from the engine 104 also flows to a fourth heat exchanger 152. The fourth heat exchanger 152 may be referred to as a radiator. The fourth heat exchanger 152 transfers heat to air passing the fourth heat exchanger 152. A cooling fan (not shown) may be implemented to increase airflow passing the fourth heat exchanger 152.

Various types of engines may include one or more turbochargers, such as turbocharger 156. Coolant may be circulated through a portion of the turbocharger 156, for example, to cool the turbocharger 156.

A coolant valve 160 may include a multiple input, multiple output valve or one or more other suitable valves. In various implementations, the coolant valve 160 may be partitioned and have two or more separate chambers. An example diagram illustrating coolant flow to and from an example where the coolant valve 160 includes 2 coolant chambers is provided in FIG. 2. The ECM 112 controls actuation of the coolant valve 160.

Figure 2:
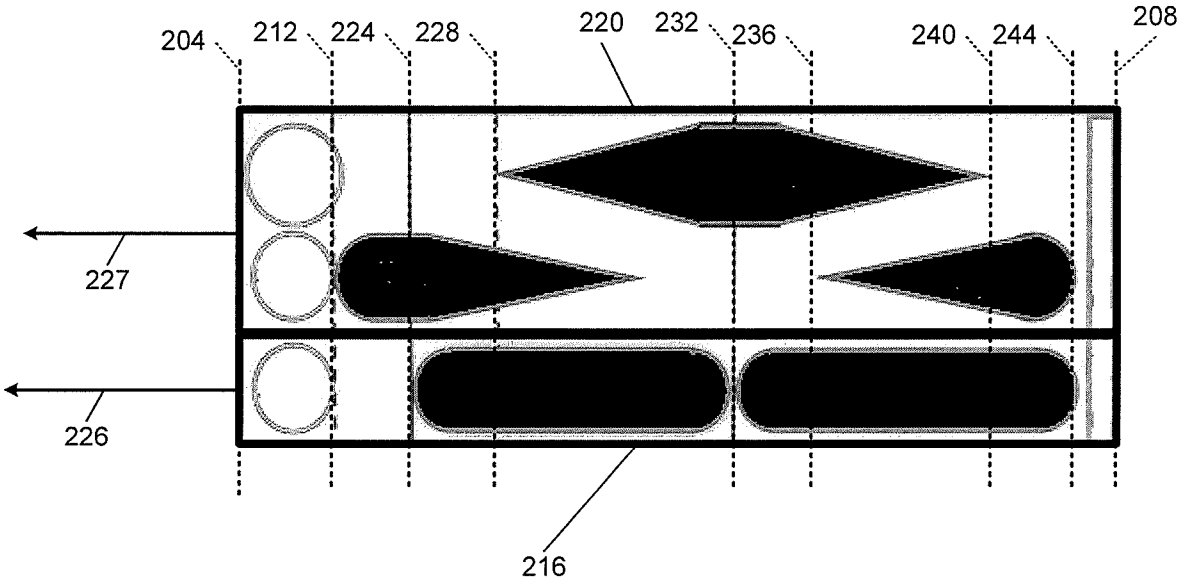
FIG. 2 is an example diagram illustrating coolant flow to and from a coolant valve for various positions of the coolant valve.

Referring now to FIGS. 1 and 2, the coolant valve 160 can be actuated between two end positions 204 and 208. When the coolant valve 160 is positioned between the end position 204 and a first position 212, coolant flow into a first one of the chambers 216 is blocked, and coolant flow into a second one of the chambers 220 is blocked. The coolant valve 160 outputs coolant from the first one of the chambers 216 to the first heat exchanger 120 and the second heat exchanger 128 as indicated by 226. The coolant valve 160 outputs coolant from the second one of the chambers 220 to the coolant pump 132 as indicated by 227.

When the coolant valve 160 is positioned between the first position 212 and a second position 224, coolant flow into the first one of the chambers 216 is blocked and coolant output by the engine 104 flows into the second one of the chambers 220 via a first coolant path 164. Coolant flow into the second one of the chambers 220 from the fourth heat exchanger 152, however, is blocked.

When the coolant valve 160 is positioned between the second position 224 and a third position 228, coolant output by the IEM 106 via a second coolant path 168 flows into the first one of the chambers 216, coolant output by the engine 104 flows into the second one of the chambers 220 via the first coolant path 164, and coolant flow into the second one of the chambers 220 from the fourth heat exchanger 152 is blocked. The ECM 112 may actuate the coolant valve 160 to between the second and third positions 224 and 228, for example, to warm the engine oil and the transmission fluid.

When the coolant valve 160 is positioned between the third position 228 and a fourth position 232, coolant output by the IEM 106 via the second coolant path 168 flows into the first one of the chambers 216, coolant output by the engine 104 flows into the second one of the chambers 220 via the first coolant path 164, and coolant output by the fourth heat exchanger 152 flows into the second one of the chambers 220. Coolant flow into the first one of the chambers 216 from the coolant pump 132 via a third coolant path 172 is blocked when the coolant valve 160 is between the end position 204 and the fourth position 232. The ECM 112 may actuate the coolant valve 160 to between the third and fourth positions 228 and 232, for example, to warm the engine oil and the transmission fluid.

When the coolant valve 160 is positioned between the fourth position 232 and a fifth position 236, coolant output by the coolant pump 132 flows into the first one of the chambers 216 via the third coolant path 172, coolant flow into the second one of the chambers 220 via the first coolant path 164 is blocked, and coolant output by the fourth heat exchanger 152 flows into the second one of the chambers 220. When the coolant valve 160 is positioned between the fifth position 236 and a sixth position 240, coolant output by the coolant pump 132 flows into the first one of the chambers 216 via the third coolant path 172, coolant output by the engine 104 flows into the second one of the chambers 220 via the first coolant path 164, and coolant output by the fourth heat exchanger 152 flows into the second one of the chambers 220.

When the coolant valve 160 is positioned between the sixth position 240 and a seventh position 244, coolant output by the coolant pump 132 flows into the first one of the chambers 216 via the third coolant path 172, coolant output by the engine 104 flows into the second one of the chambers 220 via the first coolant path 164, and coolant flow from the fourth heat exchanger 152 into the second one of the chambers 220 is blocked.

Coolant flow into the first one of the chambers 216 from the IEM 106 via the second coolant path 168 is blocked when the coolant valve 160 is between the fourth position 232 and the seventh position 244. The ECM 112 may actuate the coolant valve 160 to between the fourth and seventh positions 232 and 244, for example, to cool the engine oil and the transmission fluid. Coolant flow into the first and second chambers 216 and 220 is blocked when the coolant valve 160 is positioned between the seventh position 244 and the end position 208. The ECM 112 may actuate the coolant valve 160 to between the seventh position 244 and the end position 208, for example, for performance of one or more diagnostics.

Referring back to FIG. 1, a coolant input temperature sensor 180 measures a temperature of coolant input to the engine 104. A coolant output temperature sensor 184 measures a temperature of coolant output from the engine 104. An IEM coolant temperature sensor 188 measures a temperature of coolant output from the IEM 106. A coolant valve position sensor 194 measures a position of the coolant valve 160. One or more other sensors 192 may be implemented, such as an oil temperature sensor, a transmission fluid temperature sensor, one or more engine (e.g., block and/or head) temperature sensors, a radiator output temperature sensor, a crankshaft position sensor, a mass air flowrate (MAF) sensor, a manifold absolute pressure (MAP) sensor, and/or one or more other suitable vehicle sensors. One or more other heat exchangers may also be implemented to aid in cooling and/or warming of vehicle fluid(s) and/or components.

Output of the coolant pump 132 varies as the pressure of coolant input to the coolant pump 132 varies. For example, at a given speed of the coolant pump 132, the output of the coolant pump 132 increases as the pressure of coolant input to the coolant pump 132 increases, and vice versa. The position of the coolant valve 160 varies the pressure of coolant input to the coolant pump 132. A coolant control module 190 (see also FIG. 3) controls the speed of the coolant pump 132 based on the position of the coolant valve 160 to more accurately control the output of the coolant pump 132. While the coolant control module 190 is illustrated as being located within the ECM 112, the coolant control module 190 may be implemented within another module or independently.

Figure 3:
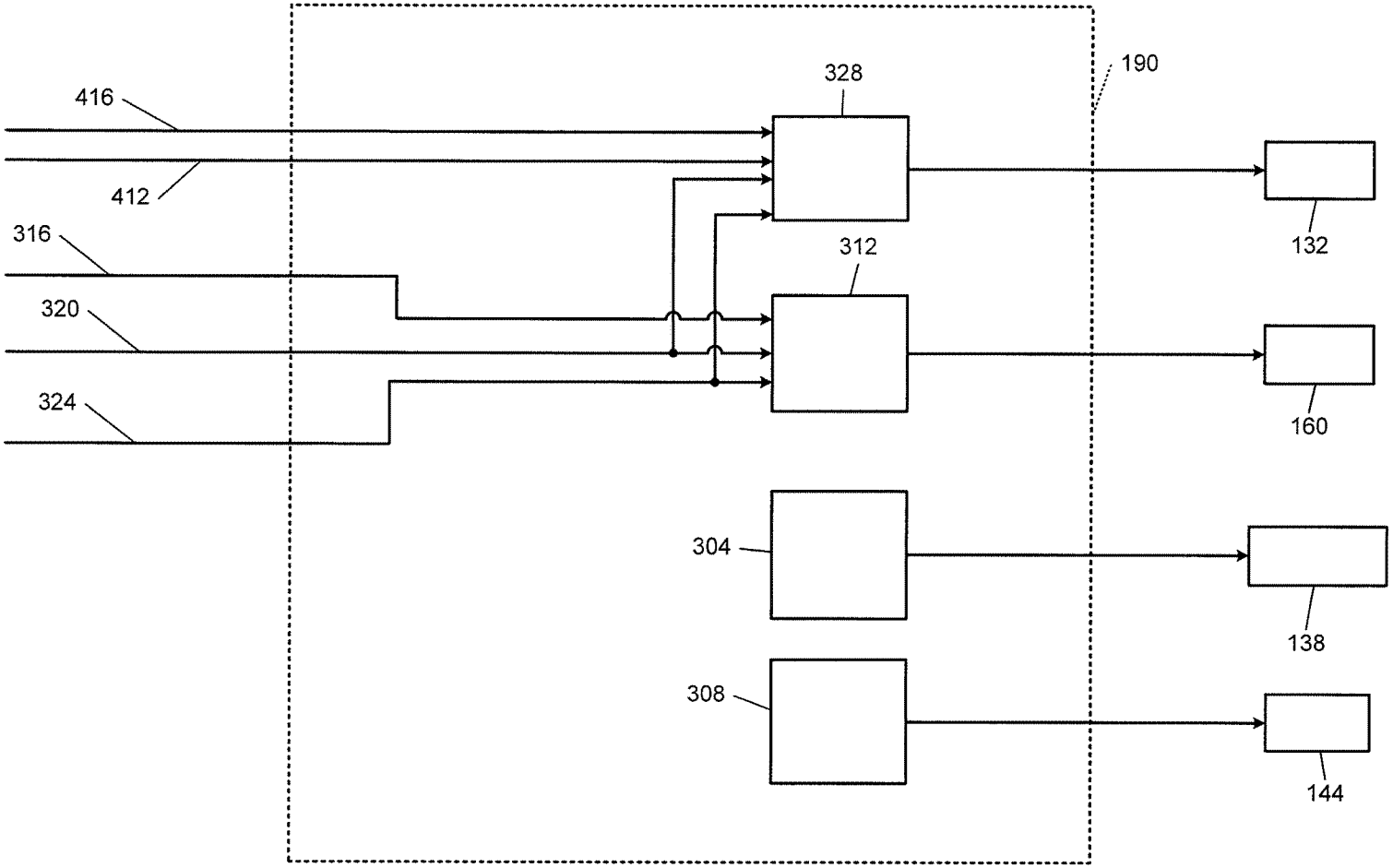
FIG. 3 is a functional block diagram of an example coolant control module.

Referring now to FIG. 3, a functional block diagram of an example implementation of the coolant control module 190 is presented. A block valve control module 304 controls the block valve 138. For example, the block valve control module 304 controls whether the block valve 138 is open (to allow coolant flow through the block portion of the engine 104) or closed (to prevent coolant flow through the block portion of the engine 104).

A heater valve control module 308 controls the heater valve 144. For example, the heater valve control module 308 controls whether the heater valve 144 is open (to allow coolant flow through the third heat exchanger 148) or closed (to prevent coolant flow through the third heat exchanger 148).

A coolant valve control module 312 controls the coolant valve 160. As described above, the position of the coolant valve 160 controls coolant flow into the chambers of the coolant valve 160 and also controls coolant flow out of the coolant valve 160. The coolant valve control module 312 may control the coolant valve 160, for example, based on an IEM coolant temperature 316, an engine coolant output temperature 320, an engine coolant input temperature 324, and/or one or more other suitable parameters. The IEM coolant temperature 316, the engine coolant output temperature 320, and the engine coolant input temperature 324 may be, for example, measured using the IEM coolant temperature sensor 188, the coolant input temperature sensor 180, and the coolant output temperature sensor 184, respectively.

Figure 4:
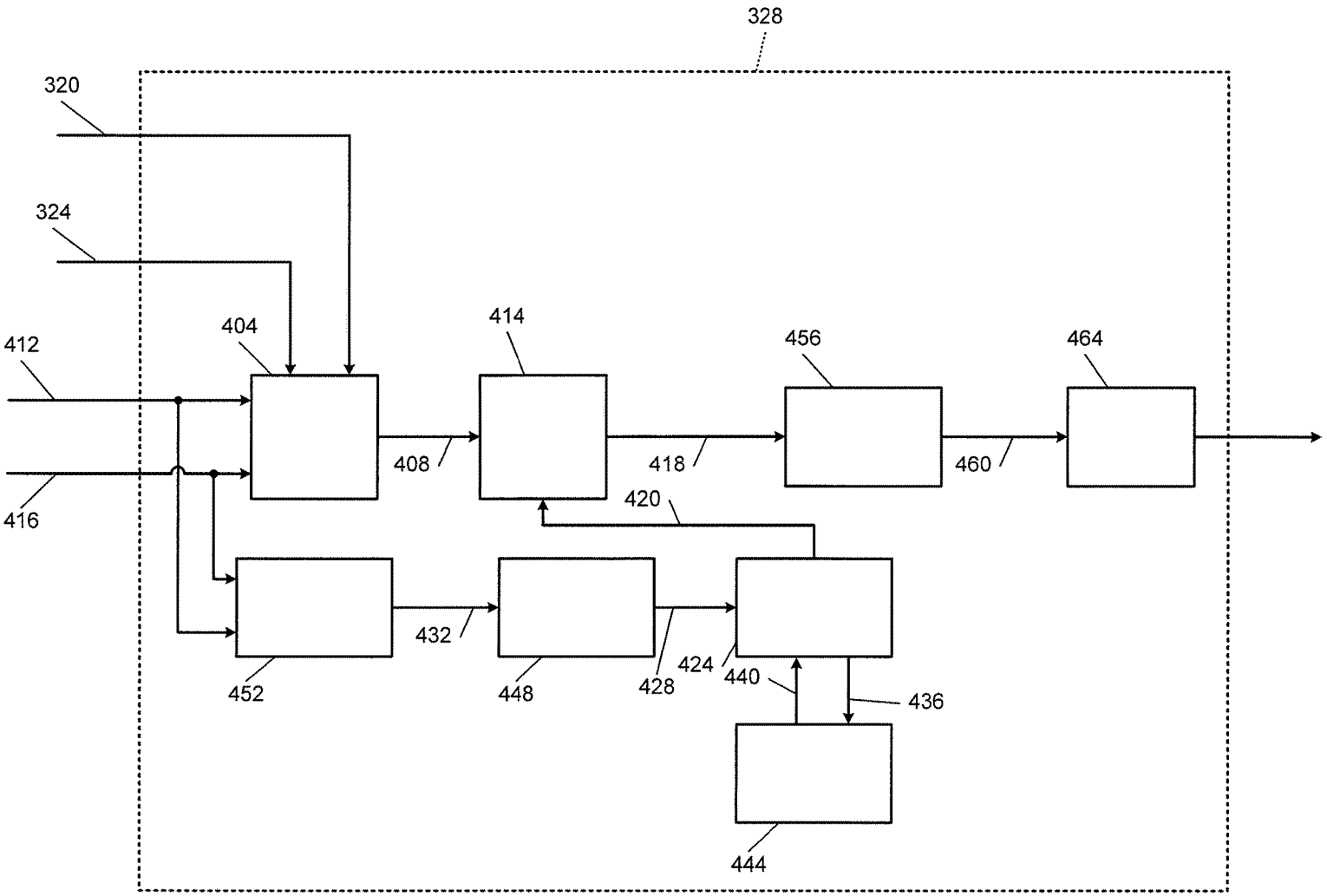
FIG. 4 is a functional block diagram of an example pump control module.

FIG. 4 includes a functional block diagram of an example pump control module 328. The pump control module 328 controls the coolant pump 132. Referring now to FIG. 4, a first target flowrate module 404 determines a first target coolant flowrate 408 through the engine 104.

The first target flowrate module 404 determines the first target coolant flowrate 408 based on an engine torque 412, an engine speed 416, the engine coolant input temperature 324, and the engine coolant output temperature 320. For example only, the first target flowrate module 404 may determine the first target coolant flowrate 408 using one or more functions and/or mappings (e.g., tables) that relate the engine torque 412, the engine speed 416, the engine coolant input temperature 324, and the engine coolant output temperature 320 to the first target coolant flowrate 408. The engine speed 416 may be, for example, measured using a sensor. The engine torque 412 may be correspond to a requested engine torque output and may be determined, for example, based on one or more driver inputs, such as an accelerator pedal position and/or brake pedal position. Alternatively, the engine torque 412 may correspond to a torque output of the engine and may be measured using a sensor or calculated based on one or more other parameters.

A second target flowrate module 414 determines a second target coolant flowrate 418 through the engine 104. The second target flowrate module 414 determines the second target coolant flowrate 418 based on the first target coolant flowrate 408 and a flowrate adjustment 420. For example, the second target flowrate module 414 may set the second target coolant flowrate 418 equal to the first target coolant flowrate 408 plus the flowrate adjustment 420. While the example of addition of the flowrate adjustment 420 with the first target coolant flowrate 408 is provided, the second target coolant flowrate 418 may be determined in another way where the second target coolant flowrate 418 is set equal to the first target coolant flowrate 408 when the flowrate adjustment 420 is equal to a predetermined flowrate and the second target coolant flowrate 418 is set to greater than the first target coolant flowrate 408, based on the flowrate adjustment 420, when the flowrate adjustment 420 is greater than the predetermined flowrate.

A flowrate adjustment module 424 sets the flowrate adjustment 420. When a change 428 in a heat input 432 to the engine 104 is greater than a predetermined change, the flowrate adjustment module 424 sets the flowrate adjustment 420 to greater than the predetermined flowrate.

The flowrate adjustment module 424 sets the flowrate adjustment 420 based on the change 428 in the heat input 432 when the change 428 is greater than the predetermined change. For example only, the flowrate adjustment module 424 may increase the flowrate adjustment 420 as the change 428 increases, and vice versa. The flowrate adjustment module 424 may determine the flowrate adjustment 420, for example, using one of a function and a mapping that relates the change 428 in the heat input 432 to the flowrate adjustment 420. If the first target coolant flowrate 408 was not increased based on the flowrate adjustment 420, coolant may boil when the change 428 is greater than the predetermined change.

The flowrate adjustment module 424 also determines a flow period 436 based on the change 428 in the heat input 432 when the change 428 is greater than the predetermined change. The flow period 436 corresponds to the period to increase the first target coolant flowrate 408 based on the flowrate adjustment 420 to prevent boiling of the coolant. The flowrate adjustment module 424 may increase the flow period 436 as the change 428 increases, and vice versa. The flowrate adjustment module 424 may determine the flow period 436, for example, using one of a function and a mapping that relates the change 428 of the heat input 432 to the flow period 436.

The flowrate adjustment module 424 sets a timer 440 tracked by a timer module 444 based on the flow period 436 when the change 428 is greater than the predetermined change. When the change 428 is less than the predetermined change, the flowrate adjustment module 424 decrements the timer 440 by a predetermined amount.

When the change 428 is less than the predetermined change and the timer 440 is greater than zero, the flowrate adjustment module 424 sets the flowrate adjustment 420 to a last value of the flowrate adjustment 420. In this manner, the flowrate adjustment module 424 maintains the flowrate adjustment 420 when the timer 440 is greater than zero and the change 428 is less than the predetermined change.

When the change 428 is less than the predetermined change and the timer 440 is less than or equal to zero, the flowrate adjustment module 424 sets the flowrate adjustment 420 equal to the predetermined flowrate. For example, in the example implementation where the second target coolant flowrate 418 is determined based on a sum of the first target coolant flowrate 408 and the flowrate adjustment 420, the predetermined flowrate may be 0.0. In this manner, the second target coolant flowrate 418 may be set equal to the first target coolant flowrate 408 when the change 428 is less than the predetermined change and the timer 440 is less than or equal to zero.

A change module 448 determines the change 428 in the heat input 432 based on a difference between a present value of the heat input 432 and the last value of the heat input 432. A heat input module 452 determines the heat input 432 based on the engine torque 412 and the engine speed 416. The heat input 432 corresponds to an amount of heat input to the engine 104. In various implementations, the heat input 432 may also include an amount of heat input to the IEM 106. The heat input module 452 may determine the heat input 432, for example, using one or more functions or mappings that relate the engine torque 412 and the engine speed 416 to the heat input 432. For example, the heat input module 452 may increase the heat input 432 as the engine torque 412 increases, and vice versa. Additionally or alternatively, the heat input module 452 may increase the heat input 432 as the engine speed 416 increases, and vice versa.

A target speed module 456 determines a target speed 460 of the coolant pump 132 based on the second target coolant flowrate 418. For example, the target speed module 456 may determine the target speed 460 using a function or a mapping that relates the second target coolant flowrate 418 to the target speed 460. A speed control module 464 controls the coolant pump 132 to achieve the target speed 460. For example, the speed control module 464 may control the application of electrical power to the coolant pump 132 to achieve the target speed 460.

Figure 5:
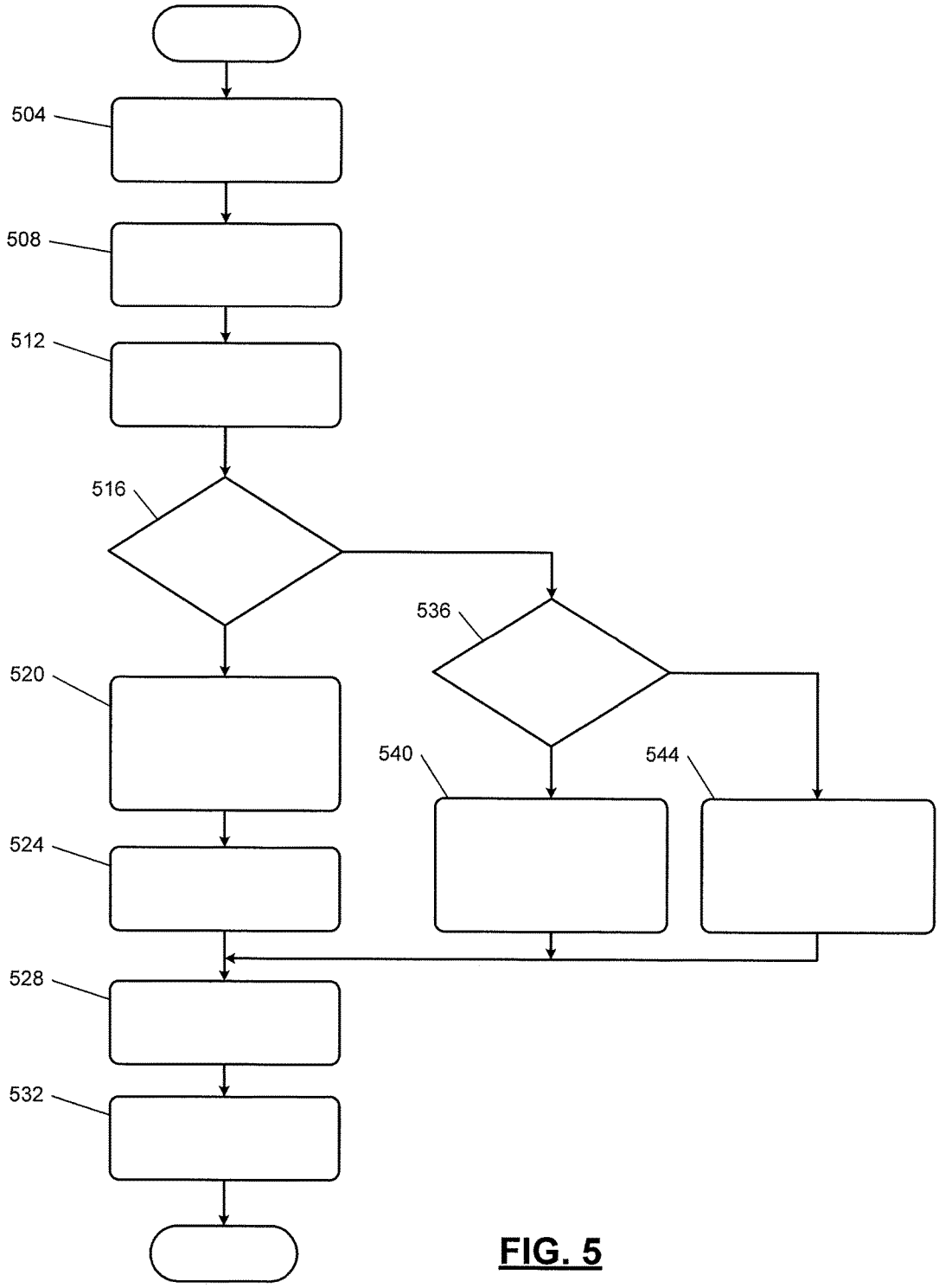
FIG. 5 is a flowchart depicting an example method of controlling a coolant pump.

Referring now to FIG. 5, a flowchart depicting an example method of controlling the coolant pump 132 is presented. Control may begin with 504 where the first target flowrate module 404 determines the first target coolant flowrate 408 of coolant through the engine 104. The first target flowrate module 404 may determine the first target coolant flowrate 408 based on the engine torque 412, the engine speed 416, the engine coolant output temperature 320, and the engine coolant input temperature 324.

At 508, the heat input module 452 determines the heat input 432 to the engine 104. The heat input module 452 may determine the heat input 432 based on the engine torque 412 and the engine speed 416. At 512, the change module 448 determines the change 428 in the heat input 432. The change module 448 determines the change 428 based on the heat input 432 determined at 508 and the last value of the heat input 432 determined during a last control loop.

The flowrate adjustment module 424 determines whether the change 428 in the heat input 432 is greater than the predetermined change at 516. If 516 is true, control continues with 520. If 516 is false, control transfers to 536, which is discussed further below.

At 520, the flowrate adjustment module 424 sets the flowrate adjustment 420 to greater than the predetermined flowrate. The flowrate adjustment module 424 sets the flowrate adjustment 420 based on the change 428 in the heat input 432. The flowrate adjustment module 424 also determines the flow period 436 at 520. The flowrate adjustment module 424 determines the flow period 436 based on the change 428 in the heat input 432.

The flowrate adjustment module 424 updates the timer 440 based on the flow period 436 at 524. Control continues with 528. At 528, the second target flowrate module 414 determines the second target coolant flowrate 418 based on the first target coolant flowrate 408 and the flowrate adjustment 420. For example, the second target flowrate module 414 may set the second target coolant flowrate 418 based on a sum of the first target coolant flowrate 408 and the flowrate adjustment 420.

At 532, the target speed module 456 determines the target speed 460 of the coolant pump 132 based on the second target coolant flowrate 418. The speed control module 464 controls the coolant pump 132 to achieve the target speed 460. While control is shown as ending after 532, the example of FIG. 5 is illustrative of one control loop, and FIG. 5 may be performed iteratively.

When the change 428 in the heat input 432 is less than the predetermined change at 516, the flowrate adjustment module 424 determines whether the timer 440 is greater than 0 at 536. If 536 is true, the flowrate adjustment module 424 decrements the timer 440 and sets the flowrate adjustment 420 equal to the last value of the flowrate adjustment 420 at 540. Control then continues with 528 and 532, as discussed above. If 536 is false, the flowrate adjustment module 424 sets the flowrate adjustment module 424 sets the flowrate adjustment 420 equal to the predetermined flowrate, such as 0, at 544. Control then continues with 528 and 532, as discussed above.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory circuits (such as a flash memory circuit or a mask read-only memory circuit), volatile memory circuits (such as a static random access memory circuit and a dynamic random access memory circuit), and secondary storage, such as magnetic storage (such as magnetic tape or hard disk drive) and optical storage.

The apparatuses and methods described in this application may be partially or fully implemented by a special purpose computer created by configuring a general purpose computer to execute one or more particular functions embodied in computer programs. The computer programs include processor-executable instructions that are stored on at least one non-transitory, tangible computer-readable medium. The computer programs may also include or rely on stored data. The computer programs may include a basic input/output system (BIOS) that interacts with hardware of the special purpose computer, device drivers that interact with particular devices of the special purpose computer, one or more operating systems, user applications, background services and applications, etc.

The computer programs may include: (i) assembly code; (ii) object code generated from source code by a compiler; (iii) source code for execution by an interpreter; (iv) source code for compilation and execution by a just-in-time compiler, (v) descriptive text for parsing, such as HTML (hypertext markup language) or XML (extensible markup language), etc. As examples only, source code may be written in C, C++, C#, Objective-C, Haskell, Go, SQL, Lisp, Java®, Smalltalk, ASP, Perl, Javascript®, HTML5, Ada, ASP (active server pages), Perl, Scala, Erlang, Ruby, Flash®, Visual Basic®, Lua, or Python®.

None of the elements recited in the claims is intended to be a means-plus-function element within the meaning of 35 U.S.C. § 112(f) unless an element is expressly recited using the phrase "means for", or in the case of a method claim using the phrases "operation for" or "step for".

What is claimed is:

1. A coolant control system for a vehicle, comprising:

a first target flowrate module that determines a first target flowrate of coolant through an engine;

a flowrate adjustment module that:

when a change in heat input to the engine from combustion within the engine is greater than a predetermined value:

determines a flowrate adjustment based on the change in the heat input to the engine;

determines a flow period for increasing coolant flow through the engine based on the change in the heat input to the engine, the determination of the flow period including:

setting the flow period to a first period if the change in the heat input to the engine is in a first range; and setting the flow period to a second period that is greater than the first period if the change in the heat input to the engine is in a second range that is greater than the first range; and maintains the flowrate adjustment for the duration of the flow period; and when the change in the heat input to the engine is less than the predetermined value and the flow period has passed, sets the flowrate adjustment to a predetermined flowrate;

a heat input module that determines the heat input to the engine from combustion within the engine based on an engine torque and an engine speed;

a second target flowrate module that determines a second target flowrate as a function of the first target flowrate and the flowrate adjustment;

a coolant valve control module that controls a position of a coolant valve, the coolant valve having:

a first chamber configured to output coolant received by the first chamber to a transmission fluid heat exchanger and an oil heat exchanger; and a second chamber configured to output coolant received by the second chamber to an engine coolant pump, the coolant valve being configured to:

when the position of the coolant valve is between a first end position and a first position, block coolant flow into the first chamber and block coolant flow into the second chamber;

when the position of the coolant valve is between the first position and a second position, block coolant flow into the first chamber, allow coolant flow from an engine into the second chamber, and block coolant flow from a radiator into the second chamber;

when the position of the coolant valve is between the second position and a third position, allow coolant flow into the first chamber from an integrated exhaust manifold, allow coolant flow from the engine into the second chamber, and block coolant flow from the radiator into the second chamber;

when the position of the coolant valve is between the third position and a fourth position, allow coolant flow from the integrated exhaust manifold into the first chamber, allow coolant flow from the engine into the second chamber, and allow coolant output by the radiator into the second chamber;

when the position of the coolant valve is between the fourth position and a fifth position, allow coolant flow into the first chamber from the engine coolant pump, block coolant flow into the second chamber from the engine, and allow coolant flow from the radiator into the second chamber;

when the position of the coolant valve is between the fifth position and a sixth position, allow coolant flow into the first chamber from the engine coolant pump, allow coolant flow into the second chamber from the engine, and allow coolant flow from the radiator into the second chamber;

when the position of the coolant valve is between the sixth position and a seventh position, allow coolant flow into the first chamber from the engine coolant pump, allow coolant flow into the second chamber from the engine, and block coolant flow from the radiator into the second chamber; and when the position of the coolant valve is between the seventh position and a second end position, block coolant flow into the first chamber and block coolant flow into the second chamber;

a target speed module that determines a target speed of the engine coolant pump based on the second target flowrate and the position of the coolant valve; and a speed control module that controls a speed of the engine coolant pump based on the target speed.

2. The coolant control system of claim 1 wherein, when the change in the heat input to the engine is greater than the predetermined value, the flowrate adjustment module increases the flowrate adjustment as the change in the heat input to the engine increases.

3. The coolant control system of claim 1 wherein, when the change in the heat input to the engine is greater than the predetermined value, the flowrate adjustment module decreases the flowrate adjustment as the change in the heat input to the engine decreases.

4. The coolant control system of claim 1 wherein the second target flowrate module sets the second target flowrate equal to the first target flowrate plus the flowrate adjustment.

5. The coolant control system of claim 1 wherein the second target flowrate module selectively sets the second target flowrate equal to the first target flowrate when the flowrate adjustment is set to the predetermined flowrate.

6. The coolant control system of claim 1 wherein the first target flowrate module determines the first target flowrate based on the engine torque and the engine speed.

7. A coolant control method for a vehicle, comprising:

determining a first target flowrate of coolant through an engine;

when a change in heat input to the engine from combustion is greater than a predetermined value:

determining a flowrate adjustment based on the change in the heat input to the engine;

determining a flow period for increasing coolant flow through the engine based on the change in the heat input to the engine, the determination of the flow period including:

setting the flow period to a first period if the change in the heat input to the engine is in a first range; and setting the flow period to a second period that is greater than the first period if the change in the heat input to the engine is in a second range that is greater than the first range; and maintaining the flowrate adjustment for the flow period;

when the change in the heat input to the engine is less than the predetermined value and the flow period has passed, setting the flowrate adjustment to a predetermined flowrate;

determining the heat input to the engine based on an engine torque and an engine speed;

determining a second target flowrate as a function of the first target flowrate and the flowrate adjustment;

controlling a position of a coolant valve, the coolant valve having:

a first chamber configured to output coolant received by the first chamber to a transmission fluid heat exchanger and an oil heat exchanger; and a second chamber configured to output coolant received by the second chamber to an engine coolant pump, the coolant valve being configured to:

when the position of the coolant valve is between a first end position and a first position, block coolant flow into the first chamber and block coolant flow into the second chamber;

when the position of the coolant valve is between the first position and a second position, block coolant flow into the first chamber, allow coolant flow from an engine into the second chamber, and block coolant flow from a radiator into the second chamber;

when the position of the coolant valve is between the second position and a third position, allow coolant flow into the first chamber from an integrated exhaust manifold, allow coolant flow from the engine into the second chamber, and block coolant flow from the radiator into the second chamber;

when the position of the coolant valve is between the third position and a fourth position, allow coolant flow from the integrated exhaust manifold into the first chamber, allow coolant flow from the engine into the second chamber, and allow coolant output by the radiator into the second chamber;

when the position of the coolant valve is between the fourth position and a fifth position, allow coolant flow into the first chamber from the engine coolant pump, block coolant flow into the second chamber from the engine, and allow coolant flow from the radiator into the second chamber;

when the position of the coolant valve is between the fifth position and a sixth position, allow coolant flow into the first chamber from the engine coolant pump, allow coolant flow into the second chamber from the engine, and allow coolant flow from the radiator into the second chamber;

when the position of the coolant valve is between the sixth position and a seventh position, allow coolant flow into the first chamber from the engine coolant pump, allow coolant flow into the second chamber from the engine, and block coolant flow from the radiator into the second chamber; and when the position of the coolant valve is between the seventh position and a second end position, block coolant flow into the first chamber and block coolant flow into the second chamber;

determining a target speed of the engine coolant pump based on the second target flowrate and the position of the coolant valve; and controlling a speed of the engine coolant pump based on the target speed.

8. The coolant control method of claim 7 wherein determining the flowrate adjustment includes, when the change in the heat input to the engine is greater than the predetermined value, increasing the flowrate adjustment as the change in the heat input to the engine increases.

9. The coolant control method of claim 7 wherein determining the flowrate adjustment includes, when the change in the heat input to the engine is greater than the predetermined value, decreasing the flowrate adjustment as the change in the heat input to the engine decreases.

10. The coolant control method of claim 7 wherein determining the second target flowrate includes setting the second target flowrate equal to the first target flowrate plus the flowrate adjustment.

11. The coolant control method of claim 7 further comprising selectively setting the second target flowrate equal to the first target flowrate when the flowrate adjustment is set to the predetermined flowrate.

12. The coolant control method of claim 7 further comprising determining the first target flowrate based on the engine torque and the engine speed.

13. A coolant control system for a vehicle, comprising:

a first target flowrate module that determines a first target flowrate of coolant through an engine based on an engine torque, an engine speed, a first temperature of coolant at an input to the engine, and a second temperature of coolant at an output of the engine;

a flowrate adjustment module that:

when a change in heat input to the engine is less than a predetermined value, sets a flowrate adjustment to a predetermined flowrate; and when the change in the heat input to the engine is greater than the predetermined value, sets the flowrate adjustment to greater than the predetermined flowrate;

a heat input module that determines the heat input to the engine from combustion within the engine based on an engine torque and an engine speed;

a second target flowrate module that determines a second target flowrate as a function of the first target flowrate and the flowrate adjustment including:

setting the second target flowrate to greater than the first target flowrate based on the flowrate adjustment being greater than the predetermined flowrate; and setting the second target flowrate equal to the first target flowrate based on the flowrate adjustment being set to the predetermined flowrate;

a coolant valve control module that controls a position of a coolant valve, the coolant valve having:

a first chamber configured to output coolant received by the first chamber to a transmission fluid heat exchanger and an oil heat exchanger; and a second chamber configured to output coolant received by the second chamber to an engine coolant pump, the coolant valve being configured to:

when the position of the coolant valve is between a first end position and a first position, block coolant flow into the first chamber and block coolant flow into the second chamber;

when the position of the coolant valve is between the first position and a second position, block coolant flow into the first chamber, allow coolant flow from an engine into the second chamber, and block coolant flow from a radiator into the second chamber;

when the position of the coolant valve is between the second position and a third position, allow coolant flow into the first chamber from an integrated exhaust manifold, allow coolant flow from the engine into the second chamber, and block coolant flow from the radiator into the second chamber;

when the position of the coolant valve is between the third position and a fourth position, allow coolant flow from the integrated exhaust manifold into the first chamber, allow coolant flow from the engine into the second chamber, and allow coolant output by the radiator into the second chamber;

when the position of the coolant valve is between the fourth position and a fifth position, allow coolant flow into the first chamber from the engine coolant pump, block coolant flow into the second chamber from the engine, and allow coolant flow from the radiator into the second chamber;

when the position of the coolant valve is between the fifth position and a sixth position, allow coolant flow into the first chamber from the engine coolant pump, allow coolant flow into the second chamber from the engine, and allow coolant flow from the radiator into the second chamber;

when the position of the coolant valve is between the sixth position and a seventh position, allow coolant flow into the first chamber from the engine coolant pump, allow coolant flow into the second chamber from the engine, and block coolant flow from the radiator into the second chamber; and when the position of the coolant valve is between the seventh position and a second end position, block coolant flow into the first chamber and block coolant flow into the second chamber;

a target speed module that determines a target speed of the engine coolant pump based on the second target flowrate and the position of the coolant valve; and a speed control module that controls a speed of the engine coolant pump based on the target speed.

* * * * *